US005788157A

United States Patent [19]

Kress

[11] Patent Number: 5,788,157

[45] **Date of Patent: *Aug. 4, 1998**

[54] SHOWER HEAD

[75] Inventor: Hermann Kress, Filderstadt, Germany

[73] Assignee: Hansa Metallwerke AG, Stuttgart, Germany

[ * ] Notice: The term of this patent shall not extend beyond the expiration date of Pat. No. 5,702,057.

[21] Appl. No.: 580,707

[22] Filed: Dec. 29, 1995

[30] Foreign Application Priority Data

Dec. 29, 1994 [DE] Germany ..... 44 47 112.2

[51] Int. Cl.[6] ..... B05B 15/02

[52] U.S. Cl. ..... 239/123; 239/147; 239/553; 239/596; 239/602

[58] Field of Search ..... 239/104, 106, 239/107, 109, 116, 117, 123, 548, 436, 447, 552, 553, 553.3, 554, 596, 602, DIG. 12

[56] References Cited

U.S. PATENT DOCUMENTS

| | | | |
|---|---|---|---|
| 2,402,741 | 6/1946 | Draviner | 239/602 |
| 4,629,124 | 12/1986 | Gruber | 239/428.5 |
| 5,172,862 | 12/1992 | Heimann et al. | 239/114 |
| 5,228,625 | 7/1993 | Grassberger | 239/558 |
| 5,405,089 | 4/1995 | Heimann et al. | 239/533.14 |

FOREIGN PATENT DOCUMENTS

G 90 17 978.1 6/1993 Germany .

*Primary Examiner*—Andres Kashnikow
*Assistant Examiner*—Lisa Ann Douglas

[57] ABSTRACT

In a known manner, a shower head, particularly for a hand shower, has a bell-shaped housing, which is closed off at the bottom by a shower base (1) and in which at least one water chamber is formed which connects with a water supply channel. The shower base (1) contains a large number of water outlet openings (15), which are made on hose-type jet attachments (11). The hose-type jet attachments (11) extend from a smooth, unbroken, continuous outer surface of the shower base (1) which is free of indentations apart from the water outlet openings (15) into the inside of the housing. In so doing they pass through a hole (3) in the shower base (1), the diameter of which is larger than the outer diameter of the jet attachment (11). In this way, there is formed round the jet attachment (11) a clear circular space (13) which does not open in the outer surface of the shower base (1) but in its inner surface. As a result of this clear circular space (13), the jet attachments (11), which are not visible from the outside, can be flexed to dislodge limescale.

11 Claims, 3 Drawing Sheets

SHOWER HEAD

Figure 1:
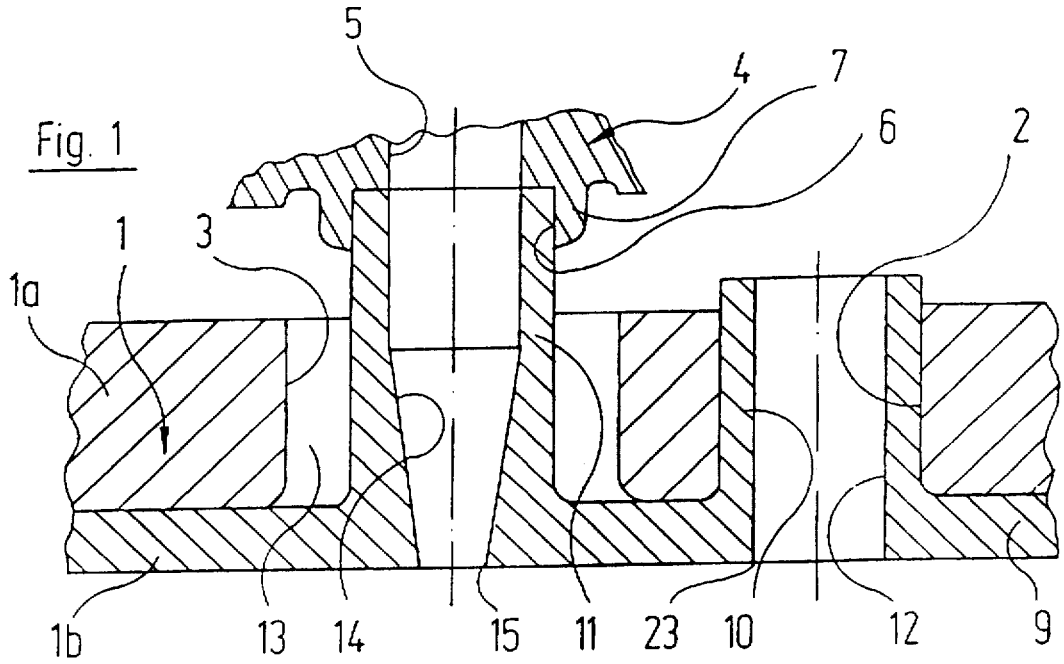

The invention concerns a shower head, particularly for a hand shower, comprising a) an essentially bell-shaped housing, in which is formed at least one water chamber which can be connected to a water supply channel;

b) a shower base, which closes off the bell-shaped housing at the bottom and has a number of water outlet openings, whereby c) the water outlet openings are made at least partly on hose-type jet attachments, which are made of an elastomer material, and whereby d) at least some of the hose-type jet attachments are surrounded, in a specific axial area, by a clear circular space such that it is possible to flex the jet attachments by hand to dislodge limescale.

It is known that over the course of the useful life of the shower head the water outlet openings in shower bases have a tendency to fur up. This manifests itself at first in a spray pattern, the geometry of which differs from that of the shower in its new state, and also a lower output per litre delivered. Limescale can build up until ultimately the water outlet openings are completely blocked.

For this reason it is known, for example as described in DE-GM 90 17 978, that water outlet openings are made in hose-type jet attachments which protrude a certain distance above the outer surface of the shower base. The hose-type jet attachments are made of an elastomer material and can be automatically flexed by stroking the hand over it so that the limescale deposited on the shell surfaces of the jet channels, particularly in the area around the water outlet openings, is dislodged. The through-flow of water through the water outlet openings in the shower base is then once again free running.

In view of the fact that the hose-type jet attachments which protruded above the outer surface of the shower base, as described by DE-GM 90 17 978 were received by some users as being aesthetically unpleasing, the hose-type jet attachments described in DE-GM 93 03 986 are relocated back in recesses in the shower base. The hose-type attachments in this design still have their free end pointing outwards. They are surrounded by circular chambers which open outwards and which provide the hose-type jet attachments with the necessary freedom of movement for flexing. The disadvantage with this is that it presents a comparatively uneven pattern of the shower base and also the fact that over the course of time dirt can build up in the easily accessible circular spaces, which is very difficult to dislodge and is unaesthetic in appearance and ultimately can obstruct the circular spaces until the desired flexing action of the jet attachments can no longer be achieved.

The purpose of this invention is to design a shower base of the type described at the beginning so that a visually more pleasing shower base is created which no longer has any recesses in its outer surface which can easily become dirty.

This task is solved according to the invention in that e) the jet attachments which, in some areas, are surrounded by a clear circular space, starting from a smooth outer surface of the spray base which has no recesses in it apart from the water outlet openings, pass through an inner hole in the shower base, the diameter of which is larger than the outer diameter of the jet attachment, such that the clear circular spaces do not open in the outer surface of the shower base but in its inner surface.

Whilst with the state of the art as discussed above, the hose-type jet attachments are always designed so that their free, moving end pointed outwards, this invention chooses another design: the jet attachments start from an unbroken, smooth outer surface of the shower base in which there are no recesses and pass radially-spaced through inner holes, i.e. those which do not open on to the outer surface of the shower base, so that they terminate inside the housing of the shower head. The invention therefore recognises for the first time that flexing is possible even when the user's hand is not directly handling the free end of the hose-type jet attachments. It is instead sufficient for a deformation of the walls of the jet channels going through the jet attachments to be achieved by applying slight pressure on the "base" of the hose-type jet attachments connected to the shower base. The flexibility of the hose-type jet attachments required for flexing is also in fact made possible in the invention due to a circular space surrounding each jet attachment. This, however, no longer inconveniently opens on to the outer surface of the shower base, but on to the inner surface. Uncovered recesses in the outer surface of the shower base, t which get dirty and could become clogged, do not therefore exist with a shower according to the invention.

The effect of manual flexing can be improved still further by the use of aids such as sponges or towels.

A preferred embodiment of the invention is therefore distinguished by the fact that the inner end of the jet attachments surrounded by a clear circular space are radially contained by a component which is rigidly connected to the housing. This allows a greater deformation of the jet attachments to be achieved when flexing than in the cases where the inner end of the jet attachments remains free.

It is an advantage if a multi-function shower has a configuration in which the component which is rigidly connected to the housing is a dividing wall which divides the inner chamber of the housing into two water chambers, in which the dividing wall has a large number of holes each of which connect with a jet channel going through a jet attachment. The dividing wall which is required anyway in a multi-function spray in this case also assumes the retaining function for the inner end of the jet attachments.

All the jet attachments can be preformed in one piece on a jet plate which, together with a perforated plate made of a rigid material, forms the shower base and extends along the outer surface of the perforated plate such that the outer surface of the jet plate is, at the same time, the outer surface of the shower base. The jet plate, which is made of a flexible material, in this way forms an impact protection for the shower base. 5.

Alternatively, each jet attachment may be a one-piece part of a jet insert which also has an area in the shape of a ring flange, in which each jet insert is introduced into a hole in a perforated plate made of rigid material, the diameter of which matches the outer diameter of the ringflange shaped area so that perforated plate and jet inserts together form a shower base, the smooth, continuous outer surface of which is formed partly by the outer surface of the perforated plate and partly by the outer surfaces of the jet inserts.

If each jet attachment, around which there is a clear circular space, has a cylindrical retaining collar round it which is preformed in one piece on the jet plate or on the jet insert, the outer shell surface of this retaining collar resting against the wall of the corresponding hole in the perforated plate, the jet plate and jet inserts respectively are to be particularly well fastened to the rigid perforated plate; the jet attachments are accurately centred in the circular spaces.

One or more reinforcing ribs can be provided in the outer shell surface of the jet attachments. These allow the deformation behaviour of the jet attachments to be varied at will, in order to optimise the effect of the manual flexing to dislodge the limescale.

From a manufacturing and engineering point of view, it is particularly simple if the jet plate and jet inserts respectively are injection moulded on to the perforated plate using the two-component technique.

It may, however, also be advisable for the jet plate to be fastened to the perforated plate so that it can be removed from the outside. In this case, the jet plate can be detached from the shower base as required, if, in an extreme case, manual flexing were no longer to be sufficient for cleaning.

With this type of configuration of the invention, which consists of a flexible jet plate which essentially covers the entire outer surface of the rigid perforated plate, the following is recommended: in this case, there can be moulded on to the rigid perforated plate a number of collar-shaped lugs which go round the outer area of at least some of the hose-type jet attachments and separate these from the jet plate. These collar-shaped lugs have several functions: firstly they separate the flexible material of the jet attachments which contributes to the deformation caused by the flexing, from the flexible material of the jet plate. In this way, the elastic deformation initiated to clean the jet attachments can be better controlled. Moreover, the collar-shaped lugs produce a certain resistance for the finger which slides, under pressure, along the underside of the shower base and this resistance shows firstly where flexing is required and secondly increases the flexing action when the finger overcomes the resistance by expenditure of force.

In multi-function showers which have the above-mentioned two water chambers separated from each other by a dividing wall, the following configuration of the invention may be incorporated: the clear circular spaces connect with one of the water chambers and are also connected to the outer surface of the shower base via ring-segment shaped openings.

This means: with this type of configuration of the invention, the circular spaces, which are actually provided so that the jet attachments can be flexed, are used in one mode of operation simultaneously as a water way to the water outlet openings, which go concentrically round the water outlet openings which correspond to the jet attachments and generally produce "hard jets". The advantage with this is that a basically similar spray pattern is achieved with both modes of operation.

Figure 2:
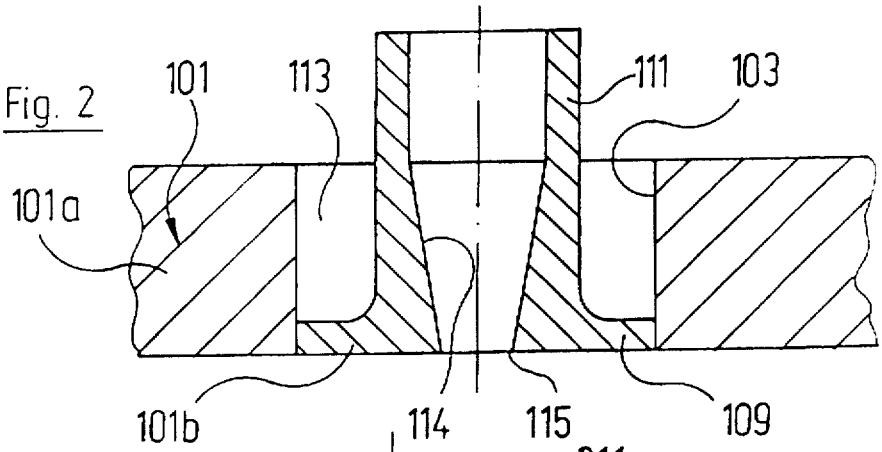
Figure 3:
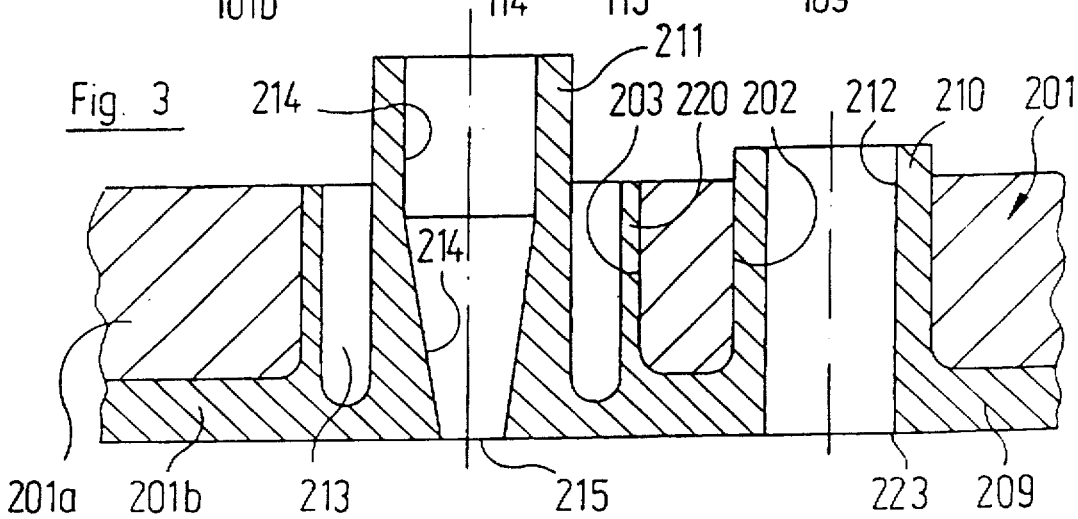
Figure 4:
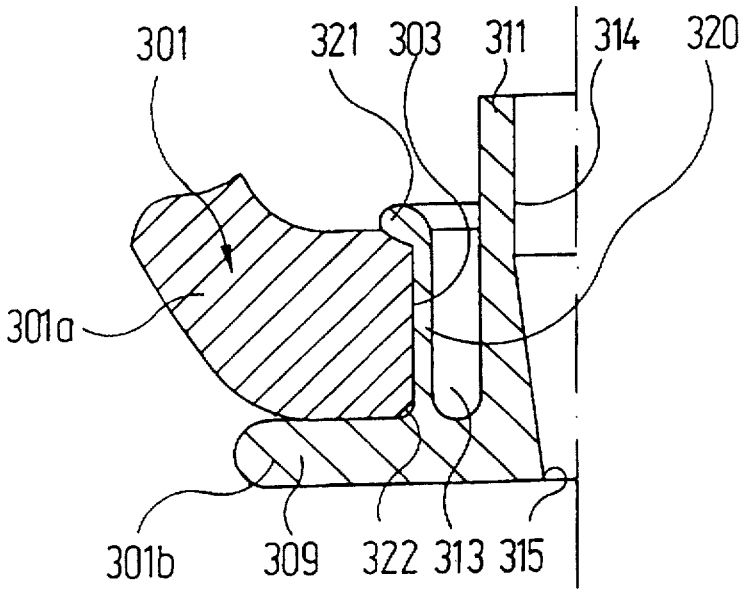
Figure 5:
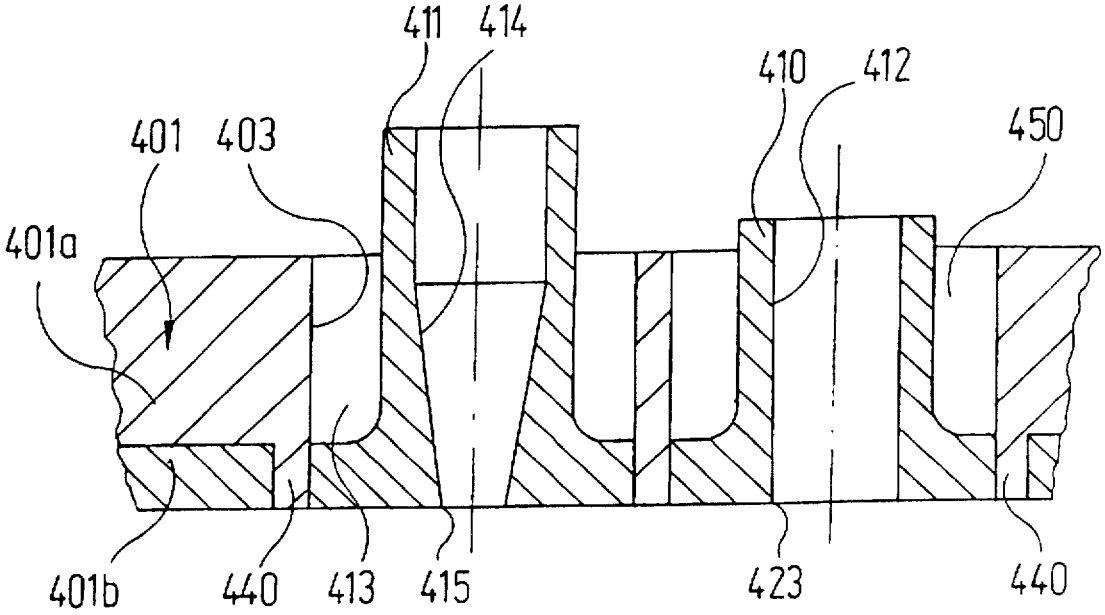
Figure 6:
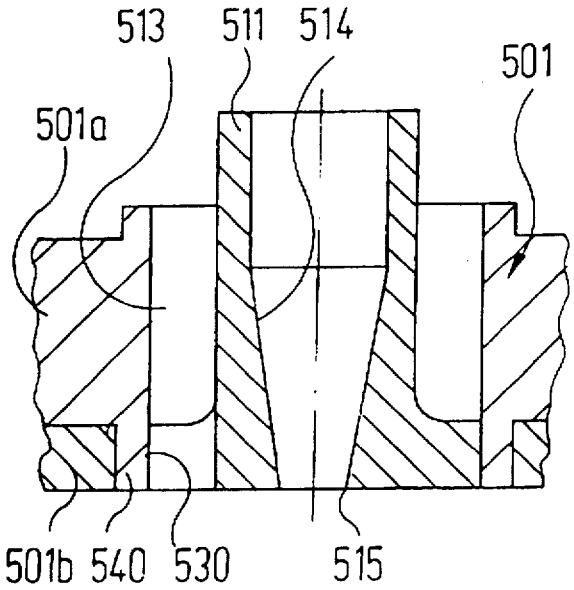
Figure 7:
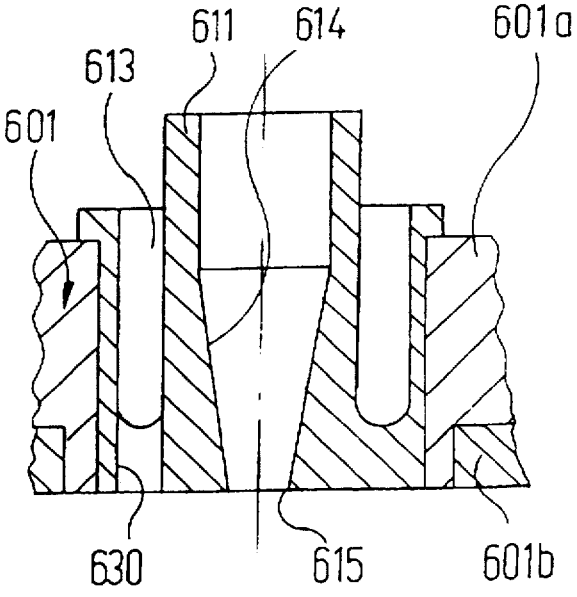

The embodiments of the invention are explained in greater detail below by reference to the drawings;

FIG. 1: shows a highly magnified cut-away of a radial section through the base zone of a shower head;

FIG. 2: shows a section, similar to that shown in FIG. 1, through a second embodiment of a shower head;

FIG. 3: shows a section, similar to that shown in FIGS. 1 and 2, through a third embodiment of a shower head;

FIG. 4: shows a section, similar to that shown in FIGS. 1 to 3, through a fourth embodiment of a shower head;

FIGS. 5 to 7: similar sections through three further embodiments of a shower head.

FIG. 1 shows a section of two components of a shower head in a highly enlarged scale:

The reference FIG. 1 designates a multi-part shower base which, in the conventional design, forms the bottom closure of a bell-shaped housing (not illustrated). It is generally circular and, at its outer circumference—in one piece, or via a detachable connection—merges into the housing of the shower head.

The shower base 1 consists of a perforated plate 1*a* made of a comparatively rigid material, which has several sets of holes arranged in concentric circles around its centre axis. FIG. 1 shows one hole each of this type 3 and 4 from two of these sets.

The holes 3 in the perforated plate, which can be imagined as being radially more to the outside, have a somewhat larger diameter, whilst the holes 2 which are radially more to the inside have a rather smaller diameter. The subject of the different diameters is discussed in greater detail below.

The shower base 1 also consists of a jet plate, which carries the reference number 1*b*. The jet plate 1*b* is made of a deformable elastomer synthetic material and is injection moulded directly on to the perforated plate using the two-component technique. As can be seen from FIG. 1, the jet plate 1*b* consists of an essentially flat base plate 9, which extends along the underside of the perforated plate 1*a* preferably as far as the outer edge. Injection moulded on to the base plate 9 of the jet plate 1*b*, and concentric to the sets of holes 3, 2 in the perforated plate 1*a* are cylindrical jet attachments 10, 11, which extend through the appropriate holes 2, 3 in the perforated plate 1*a* into the inside of the shower head.

The jet attachments 10 which correspond to the holes 2 with the smaller diameters, have an outer diameter such that they are located directly on the holes 2 in the perforated plate 1*a*; they can be injection moulded on the wall of the holes 2 with their outer shell surface. Going through each of the jet attachments 10 is a cylindrical jet channel 12 which therefore has the same diameter over its entire axial length. The axial length of the jet attachments 10 is such that this protrudes only slightly above the inner front surface of the perforated plate 1.

The jet attachments 11 of the jet plate 1*b* corresponding to the holes 3 in the perforated plate 1 have an outer diameter which is significantly smaller than the diameter of the holes 3. As a result, a clear circular space 13 is created between the outer surface of the jet attachments 11 and the wall of the holes 3.

For the second of the two components of the spray head mentioned, FIG. 1 shows an insert-type dividing wall 4 which extends essentially parallel to the perforated plate 1 through the housing of the shower head and divides this into two water chambers. One of these water chambers lies between the dividing wall 4 and the perforated plate 1; the other water space is above the dividing wall 4, between this and the bell-shaped housing of the shower head. The two water chambers can be connected, as required, via a change-over valve (not shown), to the water supply channel which, in the case of a hand shower, generally runs through the handle.

Coaxial to the larger diameter holes 3 in the perforated plate 1*a*, the dividing wall 4 has its own holes 5, which have an extension 6 at the end facing the perforated plate 1*a*. Each extension 6 of the holes 5 is surrounded by a cylindrical supporting collar 7 which is preformed on to the partition wall 4.

The axial length of the jet attachments 11 of the jet plate 1*b* is designed so that the inner, free ends of the jet attachments 11 extend into the corresponding extensions 6 of the holes 5 in the dividing wall 4, so that they have the cylindrical supporting collars 7 going round them and are held or contained radially. The seal between the jet attachments 11 and the dividing wall 4 can, as required, be made either radially, i.e. between the cylindrical surfaces of the jet attachments 11 and the collar-shaped extension 7 or axially, i.e. between the front face of the jet attachment 11 and the step between the hole 5 and the extension 6 in the dividing wall 4.

In the area adjacent to the dividing wall 4, the jet channel 14 which goes axially through the jet attachments 11 to begin with has the same diameter as the holes 5 in the dividing wall 4, but tapers conically in the area which faces outwards, so that the outlet opening 15 in the jet channel 14 has a smaller diameter than the holes 5 in the dividing wall 4. As a result of the tapering of the jet channel 14, the jets of water flowing through it become more concentrated and accelerate, with the result that they emerge from the shower as so-called "hard jets".

The shower base described above operates as follows:

If, by means of a corresponding setting of the change-over valve, the water chamber above the dividing wall 4 is connected to the water supply channel, the water flowing through it comes through the holes 5 in the dividing wall 4 and the jet channels 14 in the jet attachments 11 on the jet plate 1*b* and emerges from the outlet openings 15 in the shower head in the form of a hard jet. If, on the other hand, the change-over valve is actuated so that the water flows into the water chamber between the dividing wall 4 and the perforated plate 1*a*, then this flows through the jet channels 12 in the jet attachments 10 on the jet plate 1*b*; owing to the comparatively large diameter, the jets of water emerging from the outlet openings 23 in the jet channels 12 are comparatively slow and these, in technical jargon, are called "soft jets". As a rule, air is added to the "soft jets" before leaving the shower head 1.

Over the course of time, limescale builds up on the walls of the jet channels 12, 14, but especially on the outlet openings 15 in the jet channels 14 with their comparatively small cross-section, thus reducing the free opening and this can finally lead to a complete blockage of the jet channels 12, 14. For this reason, in the shower head illustrated, the capability is provided for the higher risk jet channels 14 producing the hard jets to dislodge these limescale deposits from the walls of the jet channels 14 and the front faces of the jet attachments 11 by "flexing" the jet attachments 11. Flexing is made possible as a result of the difference in diameter between the holes 3 in the perforated plate 1*a* and the jet attachments 11 which lead to the clear circular space 13 mentioned above. If the shower user presses his hand or a finger along the jet plate 1*b* from the bottom, then the base plate 9 flexes inwards in the area around the clear circular spaces 13 due to the elasticity of the material of the jet plate 1*b*. This flexing of the base plate 9 is accompanied by a corresponding deformation of the jet attachments 11 which, owing to the way they are held and contained in the circular supporting collars 7 on the dividing wall 4, are not able to move radially at their inner end. The result of this is a deformation of the internal wall of the jet channels 14, in which the relatively solid limescale deposits are dislodged. The nature of the deformation of the internal wall of the jet channels 14 may be different depending upon geometry and choice of material: it may involve a flexing relative to the axis of the jet channels 14, or a flattening of the cross-sectional form of the jet channels 14, e.g. from a circle to an ellipse, or a combination of various types of deformation. Details of the deformation type can be established by reinforcing ribs (not shown in the drawing) on the outer surface of the jet attachments 11. These reinforcing ribs can extend axially, helically or around the circumference and radially up to the wall of the corresponding hole in the perforated plate 1*a*. In the latter case, the circular space 13 is divided into individual annular segments. On their radially outer side, the reinforcing ribs may be moulded in one piece on to the wall of the hole. In all cases, however, it is the circular space 13 between the outer wall of the jet attachments 11 and the corresponding hole 3 in the perforated plate 1 which makes possible or facilitates deformation.

In the embodiment illustrated in FIG. 1, this type of flexing capability is not provided for the jet attachments 10 in the jet plate 1*b* which produce the soft jets. This is so because the risk of limescale build-up is generally considerably smaller in this case. If required, a circular space 13 can however also be provided between the outer wall of the jet attachments 10 and the wall of the corresponding holes in the perforated plate 1*a* to allow manual flexing.

As is clearly illustrated in FIG. 1, the outer surface of the jet plate 1*b* which is, at the same time, the outer surface of the shower base 1, has no indentations in it apart from the outlet openings 15 and 23 of the jet channels 12 and 14, as was the case in the state of the art described at the beginning. No dirt accumulations which would impair the flexing capability of the jet attachments 10, 11 can build up in the circular spaces 13, which open inwards.

FIG. 2 shows a simplified embodiment of a shower head, but one which broadly conforms to the above embodiment described with the aid of FIG. 1. Those parts which are common to both are therefore marked with the same reference number plus 100.

Once again, FIG. 2 illustrates a perforated plate 101*a* which is part of a shower base 101 and contains a number of holes 103 arranged in concentric circles. In contrast with the embodiment described in FIG. 1, there is, however, only one type of hole 103; only one type of water jet emerges from this shower head. Accordingly also, no change-over valve is fitted which would transfer the inflowing water to two different water chambers inside the housing of the shower head, as required.

A separate jet insert 101*b* is accommodated in each hole 103 in the perforated plate 101*a*. Whilst the material of which the perforated plate 101*a* is made is relatively rigid, the jet inserts 101*b* are, like the jet plate 1*b* in FIG. 1, made of an elastomer synthetic material; they are injection moulded on to the perforated plate using the two-component technique. Each jet insert 101*b* contains a ring-flange shaped area 109, the outer diameter of which matches the diameter of the holes 103. The lower front face of the jet inserts 101*b* is aligned with the outer front face of the perforated plate 101*a*, so that the shower base 101 shown in FIG. 2 also has a continuous smooth outer surface with no indentations.

Jet attachments 111 are preformed in one piece on to the ring-flange shaped area 109 and coaxial to each of the holes 103. The outer diameter of the jet attachments 111 is smaller than the diameter of the holes 103 in the perforated plate 101*a*, with the result that a clear circular space 113 is formed between the wall of the holes 103 and the outer surface of the jet attachments 111. The jet channel 114 going through the jet insert 111 coaxial to the hole 103 in the perforated plate 101*a* again tapers at its outer section, such that hard jets emerge from the outlet opening 115.

Given that the shower base 101 shown in FIG. 2 has, as already mentioned above, only one water chamber, no dividing wall like the dividing wall 4 in FIG. 1 is provided. Unlike the embodiment shown in FIG. 1, the inner ends of the jet attachments 111 are not held, i.e. the ends are free. However, in the event that a test were to prove that no adequate flexing of the jet attachments 111 is possible with the inner ends of the jet attachments 11 free, then the inner ends of the jet attachments 111 can, of course, be secured radially in a similar manner, as was the case in the embodiment shown in FIG. 1.

As with the embodiment shown in FIG. 1, in the embodiment shown in FIG. 2 there is, obviously, the capability of flexing the jet attachments 111 by hand and thus dislodging the limescale deposits from the inside walls of the jet channels 114.

FIG. 3 shows a third embodiment of a shower head which is very similar to the embodiment shown in FIG. 1. Parts which are common to both are therefore marked with the same reference number, plus 200.

FIG. 3 shows a perforated plate 201*a*, which is part of a shower base 201, with two sets of holes 202 and 203. The holes 203 have a larger diameter than the holes 202.

A jet plate 201*b* made of an elastomer synthetic material is injection moulded on to the perforated plate 201 made of a relatively rigid material using the two-component technique. It consists of a base plate 209 which runs the length of the entire under front surface of the perforated plate 201*a* and on which jet attachments 210 and 211 have been preformed coaxial to the holes 202 and 203 in the perforated plate 201*a*. The configuration of the jet attachments 210 is identical to that of the jet attachments shown in FIG. 1, with the result that the description pertaining to these can be referred to.

In addition, the configuration of the jet attachments 211 as shown in FIG. 3 is identical to that of the jet attachments 111 in FIG. 1. Even though not illustrated in FIG. 3, the jet attachments 211 of FIG. 3 are also actually supported on a dividing wall separating the inner chamber of the housing of the shower head into two water chambers, as was the case in the embodiment shown in FIG. 1. This means that, depending upon the setting of a change-over valve, the shower head illustrated in FIG. 3 produces either a hard jet from the outlet openings 215 of the jet attachments 211 or a soft jet from the outlet openings 223 of the jet attachments 210.

The only difference between the shower bases illustrated in FIGS. 1 and 3 is that in FIG. 3 additional retaining collars 220 are preformed on to the jet plate 201*b*, the outer diameter of which matches the diameter of the holes 203. The retaining collars 220 can, in this case, be injection moulded directly on to the walls of the holes 203. The circular space 213 required for flexing the jet attachments 211 is in this way formed between the retaining collars 220 and the outer surface of the jet attachments 211. Moreover, the mode of operation of the embodiment shown in FIG. 3 is identical to that of the embodiment shown in FIG. 1.

Whilst in the embodiments illustrated in FIGS. 1 and 3 and described above the jet plate and the jet insert were permanently secured to the perforated plate using the two-component technique, the same is not true of the embodiment shown in FIG. 4. This embodiment is, it is true, very similar to that shown in FIG. 3, but it has a jet plate which is inserted into the perforated plate such that it can be removed. The reference numbers used in FIG. 4 tally with those given in FIG. 1 for those parts which are common to both, but with the addition of 300.

The perforated plate 301*a*, which is made of rigid plastic has relatively large diameter holes 303 which have the same function as the holes 3, 103 and 203 shown in FIGS. 1 to 3. A jet plate 301*b* made of elastomer consists of a base plate 309, on to which is moulded, in one piece, a number of jet attachments 311. In FIG. 4, it is left open as to whether the jet plate 301*b* also has jet attachments which match the jet attachments 10 shown in FIG. 1 and 210 shown in FIG. 3. This is not important to providing a better understanding. As is clearly shown in FIG. 4, the jet attachments 311 have a smaller outer diameter than the holes 303 in the perforated plate 301*a*. As in the embodiment shown in FIG. 3, retaining collars 320 are moulded on to the base plate 309 of the jet plate 301*b*, the outer diameter of which matches the inside diameter of the holes 303. In this way, a clear space is left between the retaining collars 320 and the jet attachments 311, which allows the jet attachments 311 to be flexed, as already described several times in the foregoing, and thus the limescale deposits to be dislodged from the walls of the jet channels 314.

The inwards facing edges of the retaining collars 320 in FIG. 4 have an attachment lip 321. This protrudes outwards on the inner side of the perforated plate 301*a* and together with the corresponding attachment lips 321 on all the other jet attachments 311 secures the jet plate 301*b* to the perforated plate 301*a*.

The jet plate 301*b* can therefore be mounted on the perforated plate 301*a* by pushing the retaining collars 320 through the corresponding holes 303 in the perforated plate 301*a* which is possible due to the elasticity of the material of which the jet insert 301*b* is made. As soon as the attachment lips 321 have passed through the hole 303, they spring out and thus form an axial fixing for the jet plate 301*b*. The insertion of the retaining collars 320 and in particular the attachment lips 321 preformed on to these into the holes 303 in the perforated plate 301*a* is made easier by a chamfer 322 at the outer end of the holes 303.

The shower head illustrated in FIG. 4 has an advantage in that the jet plate 301*b* can again be removed from the perforated plate 301*a*, as required, by pulling it with a corresponding axial force. In the event, therefore, that the cleaning of the jet channels 314 achieved by flexing the jet attachments were, in exceptional circumstances, no longer to be sufficient after long period of use, the entire jet plate 301*b* can be removed and thoroughly cleaned using any method. The jet plate 301*b* is then again secured to the perforated plate 301*a* in the manner described above, so that it can be removed.

The embodiment of the invention illustrated in FIG. 5 is very similar to that shown in FIG. 1. Common parts are therefore marked with the same reference number, but with the addition of 400. The following description is limited to the differences between the embodiments based on FIGS. 5 and 1:

In the embodiment shown in FIG. 1, no circular space was provided between the jet attachments 10 which produce the "soft jets" and the rigid perforated plate 1*a*. In the embodiment shown in FIG. 5, however, there is an additional circular space 450 in each case which has the same function as the circular space 413 around the jet attachment 411. It is not necessary to give any special details on this.

The second, more significant difference can be seen from the number of collar-shaped lugs 440 which are moulded on to the rigid perforated plate 401*a* so that they go through the flexible jet plate 401*b*. The collar-shaped lugs 440 surround the jet attachments 410 and 411 concentrically. Their function is to separate the flexible material of the jet attachments 410, 411 from the flexible material of the jet plate 401*b*. An elastic deformation of the jet attachments 410, 411 caused by flexing is thus prevented from spreading into the area of the jet plate 401*b*. The material which contributes to the flexing action is therefore better defined.

The embodiment shown in FIG. 6 is very similar to the embodiment illustrated in the left half of FIG. 5. The differences are as follows:

Whilst in the embodiment shown in FIG. 5, separate jet attachments 410, 411 were provided for hard and soft jets, in the embodiment shown in FIG. 6 there is only one kind of jet attachment 511. The free ends of the jet attachments 511, shown pointing upwards in FIG. 6, are secured to an inner dividing wall in the shower base in the manner already described in the foregoing, so that the jet channels 514 in the jet attachments 511 are connected, via holes in the dividing wall, to a water chamber which is located on the side of the dividing wall facing away from the shower base. The circular spaces 513 surrounding the jet attachments 511 on the other hand connect with the water chamber which is located on the side of the dividing wall which faces the shower base 501. Leading from the bottom of the circular spaces 513 to the outer surface of the shower base 501 are several ring-segment shaped water outlet openings 530.

The embodiment shown in FIG. 6 therefore operates as follows: in one mode of operation, the water chamber lying furthest away from the base of the spray 501 is connected to the water supply. The water flows through the jet channels 514 in the jet attachments 511 and emerges from the water outlet openings 515 in the form of a hard jet.

In the second mode of operation, the water chamber closest to the shower base is connected to the water supply and has air added. This water flows through the circular spaces 513 and comes out of the shower base 501 through the ring-segment shaped openings 530 in the form of a soft jet. It is obvious that in this arrangement the water outlet openings for the soft jet mode basically have the same position as the water outlet openings for "hard jets", but these have a larger diameter and go round concentrically. The basic jet pattern, i.e. the position at which the jets of water emerge from the shower base 501*b*, remains fundamentally the same for both hard and soft jet mode in this configuration of a shower head.

The embodiment shown in FIG. 7 shows the modifications, which were described above with the aid of FIGS. 5 and 6, made to the configuration of the invention which is illustrated in the left half of FIG. 3. No additional explanation is necessary.

I claim:

1. Shower head comprising:

a) an essentially bell-shaped housing, in which at least one water chamber is formed which can be connected to a water supply channel;

b) a shower base, which closes off a bottom of the bell-shaped housing and has a number of water outlet openings, whereby c) the water outlet openings comprise at least partly on hose-type jet attachments, which are made of an elastomer material, and whereby d) at least some of the hose-type jet attachments in a specific axial area are surrounded by a clear circular space such that it is possible to flex the jet attachments by hand to dislodge limescale, wherein:

e) the jet attachments (11; 111; 211; 311; 410; 411; 511; 611) surrounded by clear circular spaces (13; 113; 213; 313; 413; 450; 513; 613) and going from a smooth outer surface of the shower base (1; 101; 201; 301; 401; 501; 601) which has no indentations apart from the water outlet openings (15; 115; 215; 315; 415; 423; 515; 615) pass through an inner hole (3; 103; 203; 303; 403; 503; 603) in the shower base (1; 101; 201; 301; 401; 501; 601), the diameter of which is larger than the outer diameter of the jet attachment (11; 111; 211; 311; 410; 411; 511; 611), such that the clear circular spaces (13; 113; 213; 313; 413; 450; 513; 613) do not open in the outer surface of the shower base (1; 101; 201; 301; 401; 501; 601) but in its inner surface.

2. Shower head according to claim 1, characterised in that the jet attachments (11) surrounded by a clear circular space (13) are radially contained at their inside end by a component (4) which is rigidly connected to the housing.

3. Shower head according to claim 2, characterised in that the component which is rigidly connected to the housing is a dividing wall (4) which divides the inner chamber of the housing into two water chambers and that the dividing wall (4) has a number of holes (5) which connect with a jet channel going through a jet attachment.

4. Shower head according to claim 3, characterised in that the clear circular spaces (513; 613) connect with one of the water chambers and are, in addition, connected to the outer surface of the shower base (501; 601) via ring-segment shaped holes (530; 630).

5. Shower head according to one of the foregoing claims, characterised in that all the jet attachments (11; 211; 311) are preformed in one piece on a jet plate (1*b*; 201*b*; 301*b*) which, together with a perforated plate (1*a*; 201*a*; 301*a*) made of rigid material, forms the base of the shower (1, 201; 301) and extends along the outer surface of the perforated plate (1*a*; 201*a*; 301*a*) such that the outer surface of the jet plate (1*b*; 201*b*; 301*b*) is also the outer surface of the shower base (1; 201; 301).

6. Shower head according to claim 5, characterised in that each jet attachment (211; 311) surrounded by a clear circular space (213; 313) has a cylindrical retaining collar (220; 320) going around it which is preformed in one piece on the jet plate (201*b*, 301*b*) or on the jet insert, the outer shell surface of this retaining collar resting against the wall of the appropriate hole (203; 303) in the perforated base (201*a*; 301*a*).

7. Shower head according to claim 5, characterised in that a number of collar-shaped lugs (440) are moulded on to the rigid perforated plate (401*a*), which go round the outer area of at least one part of the hose-type jet attachments (410, 411) and separate these from the jet plate (401*b*).

8. Shower head according to claim 1, characterised in that the jet plate (1*b*; 201*b*) and the jet inserts (101*b*) respectively are injection moulded on to the perforated plate (1*a*; 101*a*; 201*a*) using the two-component technique.

9. Shower head according to any one of the claims 1, characterised in that the jet plate (301*b*) is attached to the perforated plate (301*a*) so that it can be detached from the outside.

10. Shower head according to claim 1, characterised in that each jet attachment (111) is a single piece part of a jet insert (101*b*) which also has a ring flange shaped area (109) and that each jet insert (101*b*) is introduced into a hole (103) in a perforated plate (101*a*) made of rigid material, the diameter of which matches the outer diameter of the ring flange shaped area (109) so that perforated plate (101*a*) and jet inserts (101*b*) together form a shower base (101), the smooth, continuous outer surface of which is formed partly by the outer surface of the perforated plate (101*a*) and partly by the outer surfaces of the jet inserts (101*b*).

11. Shower head according to claim 1, characterised in that, on their outer shell surface, the jet attachments are provided with one or more reinforcing ribs.

* * * * *